United States Patent [19]

Busick

[11] Patent Number: 4,625,472

[45] Date of Patent: Dec. 2, 1986

[54] GEODESIC DOME PREFABRICATED PANELS

[76] Inventor: Michael F. Busick, 401 N. Harbor City Blvd., Melbourne, Fla. 32935

[21] Appl. No.: 544,697

[22] Filed: Oct. 24, 1983

[51] Int. Cl.[4] ..... E04B 1/32; E04C 1/10

[52] U.S. Cl. ..... 52/81; 52/309.12; 52/259; 52/440; 52/583; 52/612

[58] Field of Search ..... 52/81, 86, 583, 587, 52/440, 612, 309.9, 309.12, 259, 436, 438, DIG. 10

[56] References Cited

U.S. PATENT DOCUMENTS

| | | | |
|---|---|---|---|
| 2,897,668 | 8/1959 | Graham | 52/583 |
| 2,920,475 | 1/1960 | Graham | 52/587 |
| 3,192,668 | 7/1965 | Grieb | 52/583 |
| 3,197,927 | 8/1965 | Fuller | 52/81 |
| 3,296,755 | 1/1967 | Chisholm | 52/81 |
| 3,464,175 | 9/1969 | Akita | 52/612 |
| 3,596,423 | 8/1971 | Jacobus | 52/583 |
| 4,077,177 | 3/1978 | Boothroyd | 52/80 |

FOREIGN PATENT DOCUMENTS

| | | | |
|---|---|---|---|
| 230326 | 9/1959 | Australia | 52/80 |
| 1540431 | 8/1968 | France | 52/438 |
| 2051918 | 1/1981 | United Kingdom | 52/DIG. 10 |

*Primary Examiner*—Henry E. Raduazo

*Attorney, Agent, or Firm*—Duckworth, Allen & Dyer

[57] ABSTRACT

A geodesic dome construction system utilizing a plurality of prefabricated panels having a triangular shape. Each panel includes a core of insulative material, an exterior cementitious face, an interior wall surface face, and edges of the core at an angle with respect to the faces. The exterior face includes an uncovered border portion and a wire mesh extending from the cementitious face into the border portion. The panels are assembled edge-to-edge to form a dome and the joints between panels reinforced with a wire mesh strip. The border portions and exposed wire mesh are covered with cured cementitious material forming a reinforced concrete rib along each joint.

15 Claims, 5 Drawing Figures

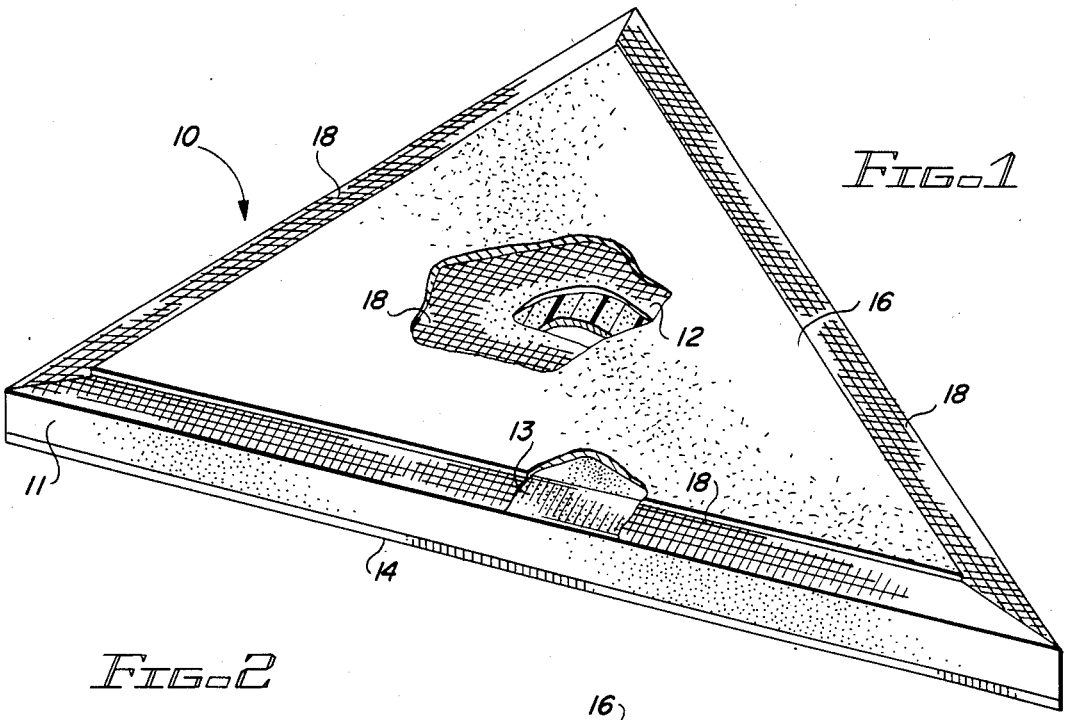
FIG. 1
FIG. 2
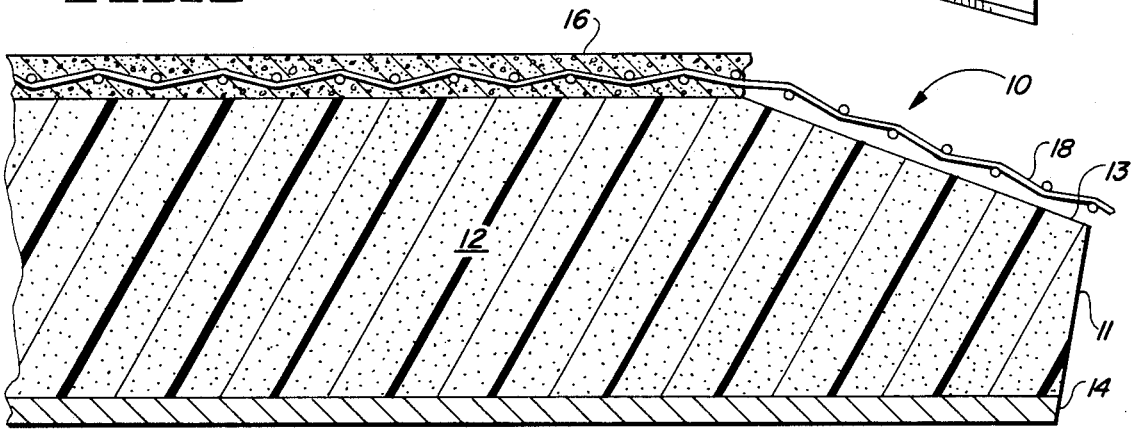
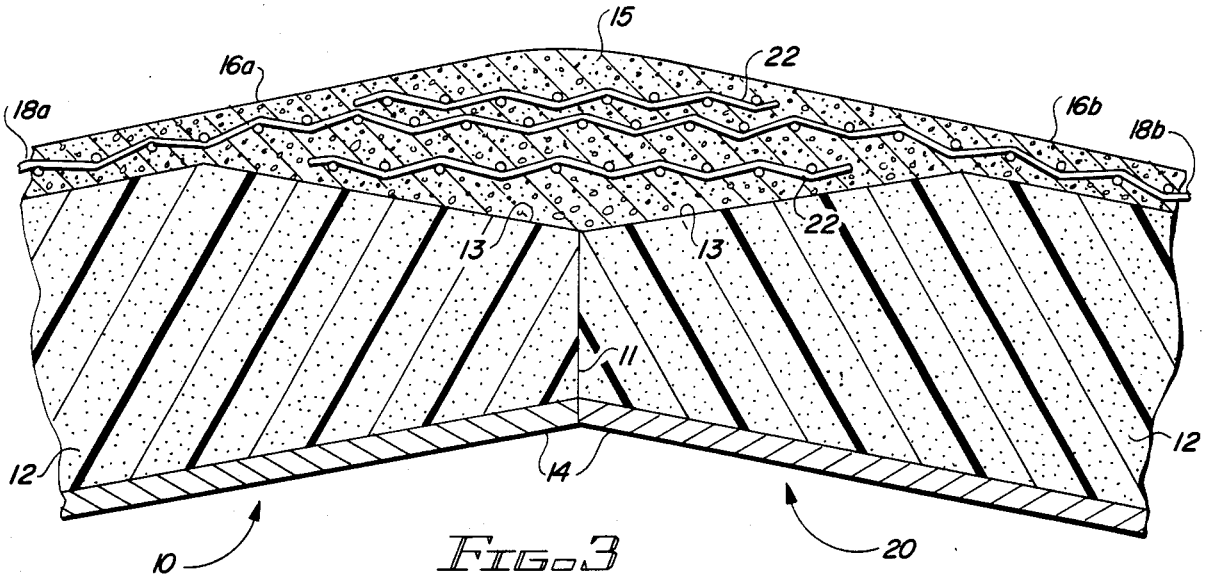
FIG. 3

GEODESIC DOME PREFABRICATED PANELS

BACKGROUND OF THE INVENTION

1. Field of the Invention

The present invention relates to geodesic dome structures and more particularly to a system of prefabricated panels for construction of geodesic dome structures. 2. Description of the Prior Art Since the geodesic dome structure was developed by R. B. Fuller and disclosed in U.S. Pat. No. 2,682,235, many techniques and systems have been developed and proposed for construction of domes. While the geodesic dome has inherent advantages in efficiency of use of space and in the strength of the structures, domes do not lend themselves readily to conventional construction methods. Domes have been constructed with panels having wood framing and plywood sheeting. The time and labor required for this construction is relatively high, and the materials are not fireproof. Thus, interest has developed in the use of concrete for geodesic domes. For example, in U.S. Pat. No. 4,114,680 to Kelly, a dome-shaped building is shown which requires a supporting framework with an inside shell formed of concrete mesh and reinforcing members and an outside shell spaced from the inside shell. A rather complex structure is required, and the desirable goal of low-cost construction is clearly missed. Dickens et al in U.S. Pat. No. 4,094,110 describe a better structure having panels of expanded polystyrene from which dome-type buildings can be constructed. The outer surface of the panels is covered with wire mesh, and thin metal strips are bonded to the front and back of the panels, along the edges. The panels are assembled to form a desired structural form with the panels joined together by screws through the metal strips. The wire mesh is then covered with concrete or a similar material by spraying or troweling. The interior surfaces are then covered with plaster, concrete, or other finishing materials. As may be recognized, the Dickens et al system requires extensive on-site construction. In U.S. Pat. No. 4,330,969 to Quaney, molding of structural panels in a uniform or modularized size is taught. The panel requires a base portion and a flange around its periphery. The panels are assembled to form geodesic domes and other structures in a flange-to-flange manner and secured by fasteners or by bonding. Although the Quaney panels may provide insulating qualities, a structure fabricated from such panels would lack the strength of a concrete structure. Hewitt describes, in U.S. Pat. No. 2,223,418, a concrete dome structure. The dome is constructed with precast sections having concentric rows of slab sections, with the outer edge of each row overlapping the inner edge of the next row. Since the adjacent precast sections must interlock, a very large number of different size and shape slabs would be required and the system would lack versatility. Furthermore, no inherent insulation is provided.

Thus, the prior art fails to provide a flexible system for prefabricating geodesic dome panels having high insulating capabilities which have finished outside coatings and interior finishing and which can be assembled on-site with minimum labor and material.

SUMMARY OF THE INVENTION

My invention is a geodesic dome assembled from prefabricated panels having a triangular shape. Each panel comprises a core of expanded bead polystyrene.

The core may be of any desired thickness, although I find that six inches to nine inches in thickness is generally suitable. The surface which will face the interior of a building has bonded to it gypsum board, paneling, or other type of wall forming material. The outer surface of each panel is covered with a wire mesh embedded in fiber-reinforced concrete or other cementitious material. The edges of each panel are trimmed at the appropriate angle so that the panels will fit together.

The cementitious layer on the outer surface of the panel extends to within a few inches of the edges of the panel, while the embedded wire mesh extends to the panel edge. When the panels are assembled on the site, it may recognized that the joints will show in the form of exposed polystyrene panel borders covered with the wire mesh edges. Additional wire mesh strips are placed in the joint or seam area overlapping the mesh extending from the panel. The seam area is then filled with a concrete or fiber-reinforced cementitious slurry of the same type as the outside covering material. When the slurry cures, the cementitious material bonds to the polystyrene foam and to the existing cementitious surface layers on each panel, and covers the exposed wire mesh which acts as reinforcing. It will also be noted that the wire mesh strips placed over each seam in combination with the mesh extending from the panel coating produces a rib having high tensile, flexural, and compressive strength between each pair of panels.

Preferably, the interior wallboard or other wall covering material extends to the edges of each panel. Thus, when the panels are assembled as described above, only a very small gap will occur on the interior surface. In the case of gypsum board or similar wallboard, these gaps can be covered by taping or similar well known treatments. Alternatively, the interior surface can be painted or wallpapered.

As may now be understood, by the use of my prefabricated triangular shaped panels, a geodesic dome can be constructed by joining of the panels, and seaming the panels together with concrete or other fiber-reinforced cementitious material to form a complete integral seamless dome shell, and in which the bonds between the panels have high tensile, flexural, and compressive strength. A minimum of labor and materials is needed on site for this type of construction. The resulting dome provides a large interior volume with no load bearing walls required.

It is therefore a principal object of my invention to provide a prefabricated building panel having a weather tight surface, high thermal insulation, and an interior wall surface.

It is another object of my invention to provide building panels which have means for joining adjacent panels so as to have a high strength structural rib therebetween.

It is still another object of my invention to provide prefabricated building panels which can be assembled together and joined to form an integral seamless shell in which each panel provides inherent load bearing capability.

It is yet another object of my invention to provide prefabricated building panels having means for creating bonds of high tensile strength when joined to adjacent panels.

It is a further object of my invention to provide a prefabricated building panel system for constructing geodesic domes.

These and other objects and advantages of my invention will become apparent from the following detailed description when read in conjunction with the drawings.

BRIEF DESCRIPTION OF THE DRAWINGS

FIG. 1 is a prespective view of a typical panel of the invention;

FIG. 2 is a cross sectional view of an edge of the panel of FIG. 1;

FIG. 3 is a cross sectional view of a joint between twopanels having a reinforced concrete rib formed along the joint;

DETAILED DESCRIPTION OF THE PREFERRED EMBODIMENT

Figure 5:
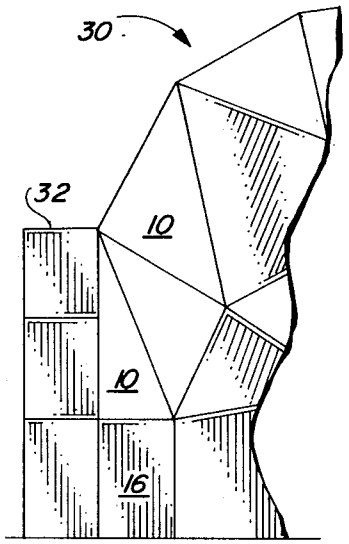
FIG. 5 is a partial cross section of the entrance opening of FIG. 4.

Referring to FIG. 1, a perspective view of a typical prefabricated panel 10 in accordance with my invention is shown having a cutaway section showing the interior construction thereof. Panel 10 is triangular in shape and comprises a planar core 12 preferably of expanded bead polystyrene. The thickness of core 12 may be selected as appropriate to the thermal insulation desired. For typical buildings, a thickness of six to nine inches provides sufficient strength and insulation value. The external surface is preferably a fiber-reinforced cementitious material 16 which is applied over the outside face of core 12. In accordance with my invention, the cementitious material 16 extends to within several inches of each edge of the panel 10 as best seen in FIG. 2. The outer edges 13 taper slightly inwardly as seen in the cross sectional view of FIG. 2 and the edge cutaway portion of FIG. 1. Each panel edge 11 is cut at an angle to mate with adjacent panels for producing the desired three dimensional structural shape. It is to be understood that the size, edge angles, and vertex angles of each panel 10 are selected to suit the specific structure to be assembled therefrom.

Steel wire mesh 18 is embedded in cementitious material 16 over the entire outer surface of panel 10 and extends out from material 16 to the edges of panel 10 as seen best in FIG. 2.

The interior surface of core 12 may be finished with gypsum board 14 or other wall surfacing material such as plaster or plywood paneling. Board 14 may be bonded to the interior surface by any suitable adhesive.

As will now be apparent, my invention contemplates the prefabrication of a set of triangular panels 10 having vertex angles and edge angles tailored such that the panels will mate together to form a geodesic dome. The interior and exterior surfaces are prefinished to minimize on-site operations and to permit production line techniques during prefabrication to minimize costs.

The assembly of the joints is shown in FIG. 3 in which panel 10 is joined with panel 20. When first installed, it will be understood that border areas 13 of each panel are exposed, forming panel borders along joint 11. At this point, two strips of steel wire mesh 22 may be installed within the panel borders with one strip below the wire mesh 18*a* projecting from external coating 16*a* and mesh 18*b* projecting from external coating 16*b*. The other strip 11 lays on top of mesh 18*a* and 18*b*. Alternatively, a single strip has been determined to provide sufficient reinforcement for most applications. A slurry of cementitious material 15 is troweled or sprayed over surfaces 13 and formed as seen in the cross section of FIG. 3. Material 15 bonds to the surfaces 13 of core material 12, the edges of external coatings 16*a* and 16*b*, and mesh 18*a*, 18*b*, and 22. When cementitious material 15 cures, it forms a reinforced concrete rib adding high tensile, flexural and compressive strength.

The interior joints at the edges of board 14 may be filled, taped, or otherwise finished. The interior surfaces may be painted, plastered, wall papered, or given any other desired treatment.

Figure 4:
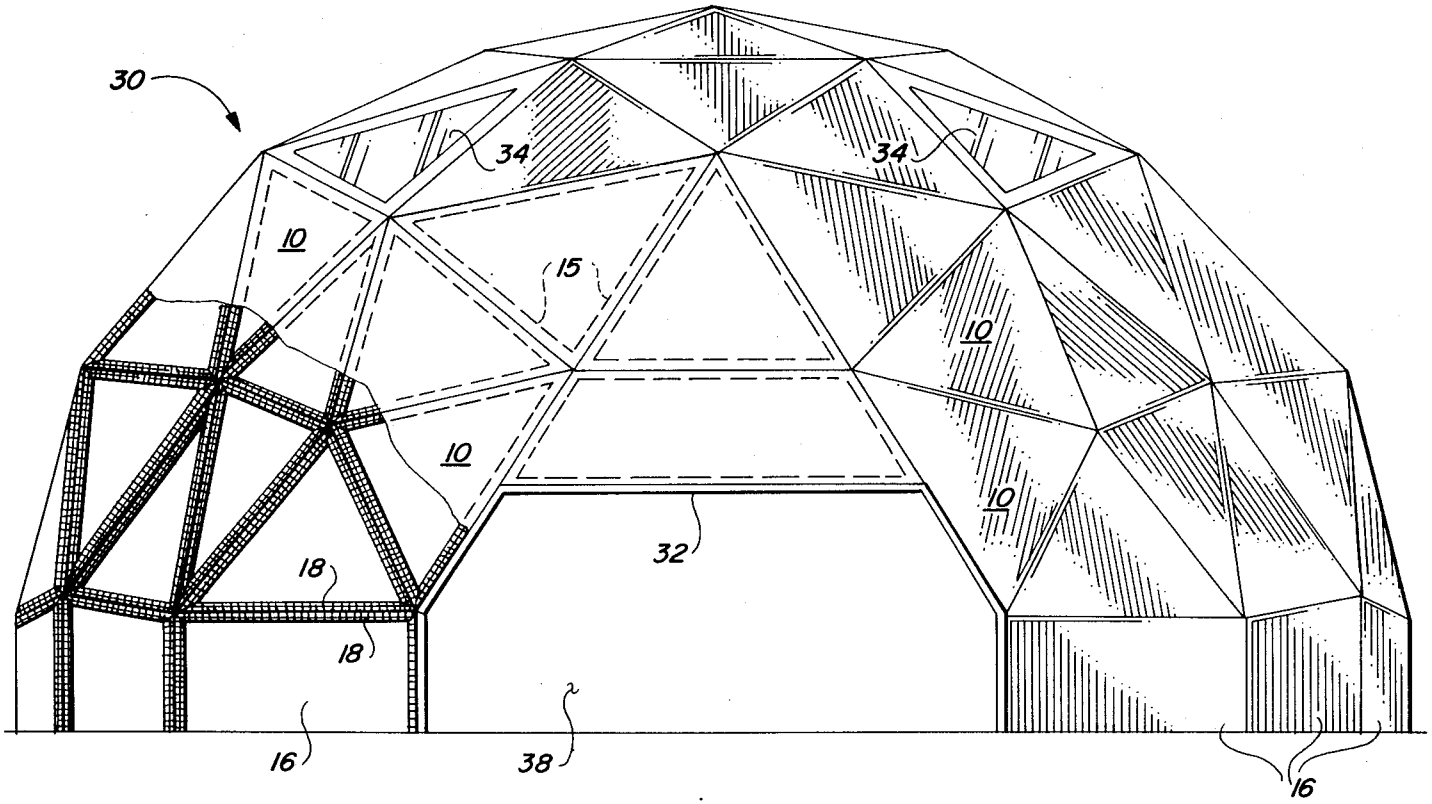
FIG. 4 is a typical geodesic dome formed from joined panels showing a number of joints prior to forming the ribs of FIG. 3.

Having now described the construction of my prefabricated panels, the assembly of a typical structure from such panels will be described. Turning to FIG. 4, a geodesic dome 30 is shown. A variety of panels 10 of the invention are assembled to form the dome portion of the building while special quadrilateral panels 16 form the base portion. The panels shown in the lower left portion of the structure 30 are as first assembled with wire mesh edges 18 exposed. The balance of the panels have the joints filled with cementitious material forming ribs 15, indicated by the dashed lines along the panel joints.

After all joints are filled, it may be noted that dome structure 30 is an integral seamless dome shell and the joints form an interlocking grid of reinforced concrete ribs 15. Thus, an extremely strong, rigid shell having no interior load bearing posts or walls results.

One or more openings 38 may be left for window and door walls. Opening 38 may be framed with an eave structure 32 as best seen in side view of FIG. 5. Eave structure 32 may be reinforced with wire mesh and coated with cementitious material faired into the edges of adjacent panels 10 and 16. Skylights or windows 34 may be prefabricated into any of the panels 10 without significantly affecting the strength and rigidity of the structure due to the novel ribs 15 formed during assembly.

Although I have described my invention with reference to certain specific materials and arrangements, it will be obvious to those of skill in the art to substitute other materials and to modify the arrangements without departing from the spirit and scope of the invention.

I claim:

1. A lightweight structural building panel having a shape compatible for use in assembling a geodesic dome structure comprising:

a core portion formed from insulative material, said core portion having an exterior face, an interior face and a plurality of bordering portions;

a wall covering attached to said interior face;

an exterior coating of cementitious material over and attached to said exterior face except for each of said bordering portions along the edges of said exterior face; and a wire mesh coextensive with said core portion, said wire mesh embedded in said exterior coating and extending into an area above said bordering portions thereof adjacent said exterior face, said insulative material having a thickness substantially greater than the combined thickness of said interior covering and said exterior coating.

2. The panel as defined in claim 1 in which said panel is triangular in shape.

3. The panel as defined in claim 1 in which said core portion is formed from beaded polystyrene.

4. The panel as defined in claim 1 in which the edges of said panels are cut at an angle whereby mating of one of said panels with another of said panels produces a preselected three dimensional shape.

5. The panel as defined in claim 1 in which said border portions of said exterior face form an angle with respect to the rest of said exterior face.

6. The panel as defined in claim 1 in which said cementitious material is fiber-reinforced concrete.

7. A three dimensional structure comprising:

(a) a plurality of polygonal structural panels, each of said panels having (i) a planar core portion of insulative material having an exterior face and an interior face parallel to said exterior face, and having a plurality of bordering edges at a preselected angle with respect to said faces, (ii) a wall covering attached to and coextensive with said interior face, (iii) an exterior coating of cementitious material covering a central portion of said exterior face so as to leave uncovered each of said bordering edges of said exterior face, and (iv) a wire mesh coextensive with said core portion, said wire mesh embedded in said exterior coating and extending from said coating over said bordering edges; and (b) said plurality of polygonal structural panels assembled with each of said edges of said core portions contiguously joined with an adjacent one of said edges to form a joint, said joined panels defining a three dimensional exterior surface, each of said joints having (i) at least one reinforcing strip of wire mesh disposed along said joint overlapping said extending wire mesh of each adjacent pair of said panels, and (ii) a cured cementitious material covering said reinforcing wire mesh and bonding to said exterior coating of cementitious material and said border portion to form a continuous reinforced concrete rib along each of said joints.

8. The structure as defined in claim 7 in which said structure is a geodesic dome.

9. The structure as defined in claim 8 in which said structure includes an opening for doors and windows.

10. The structure as defined in claim 8 in which at least one of said structural panels includes a skylight therethrough.

11. The structure as defined in claim 7 in which a first strip of wire mesh underlies said projecting wire meshes and a second strip overlies said projecting wire meshes.

12. The structure as defined in claim 7 in which at least some of said polygonical structural panels are triangular shaped.

13. A lightweight structural building panel having a shape suitable for construction of a geodesic dome; comprising:

a thermally-insulating core portion having a nominal thickness of between 6 and 9 inches, said core portion having an exterior face, an interior face and a plurality of bordering edges;

an exterior coating of cementitious material over and attached to said exterior face except for each of said bordering edges along said exterior face; and a wire mesh coextensive with said core portion, said wire mesh embedded in said exterior coating except for said bordering edges thereof adjacent said exterior face.

14. The structural building panel of claim 13 and including:

a wall convering attached to said interior face of said core portion, said wall covering comprising an interior wall forming material having a thickness substantially less than the thickness of said core material.

15. A lightweight structural building panel having a shape compatible for use in assembling a geodesic dome structure comprising;

a core portion formed from insulative material, said core portion having an exterior face, and an interior face;

an exterior coating of cementitious material over and attached to said exterior face except for a border portion along an edge of said exterior face;

a wire mesh coextensive with said core portion, said wire mesh embedded in said exterior coating and having a portion thereof extending from said exterior coating over said border portion, said wire mesh enabling joining of adjacent panels having abutting insulative material, said insulative material having a thickness substantially greater than the combined thickness of said interior covering and said exterior coating.

* * * * *